US007704446B2

(12) United States Patent
Dry et al.

(10) Patent No.: US 7,704,446 B2
(45) Date of Patent: Apr. 27, 2010

(54) INDUCING SWIRL IN A GAS FLOW

(75) Inventors: Rodney James Dry, City Beach (AU); Mark Preston Davis, West Shelley (AU); Hector Medina, Melville (AU)

(73) Assignee: Technological Resources Pty. Limited, Melbourne (AU)

( * ) Notice: Subject to any disclaimer, the term of this patent is extended or adjusted under 35 U.S.C. 154(b) by 313 days.

(21) Appl. No.: 11/443,099

(22) Filed: May 31, 2006

(65) Prior Publication Data

US 2007/0119966 A1 May 31, 2007

(30) Foreign Application Priority Data

May 31, 2005 (AU) ..... 2005902809

(51) Int. Cl.
*F02M 47/02* (2006.01)

(52) U.S. Cl. ..... 266/217; 266/270

(58) Field of Classification Search ..... 266/217, 266/225, 268, 270

See application file for complete search history.

(56) References Cited

U.S. PATENT DOCUMENTS 6,440,356 B2 * 8/2002 Dunne ..... 266/225
6,673,305 B2 * 1/2004 Dunne et al. ..... 266/225
6,773,659 B2 * 8/2004 Dunne et al. ..... 266/225
6,939,391 B2 * 9/2005 Dry et al. ..... 266/225
2001/0033046 A1 * 10/2001 Dunne ..... 266/217
2002/0158377 A1 * 10/2002 Dunne et al. ..... 266/217
2003/0011114 A1 * 1/2003 Dunne et al. ..... 266/225
2006/0108722 A1 * 5/2006 Williams et al. ..... 266/217
2006/0108723 A1 * 5/2006 Williams et al. ..... 266/217
2007/0119966 A1 * 5/2007 Dry et al. ..... 239/88
2008/0128963 A1 * 6/2008 Cingle et al. ..... 266/225
2008/0258321 A1 * 10/2008 Tierney et al. ..... 261/160
2008/0265473 A1 * 10/2008 Dengel et al. ..... 266/225

* cited by examiner

*Primary Examiner*—Scott Kastler
(74) *Attorney, Agent, or Firm*—Finnegan, Henderson, Farabow, Garrett and Dunner, L.L.P.

(57) ABSTRACT

The present invention relates to an apparatus for injecting gas into a vessel. The apparatus may include a gas flow duct and a central body within a forward end region of the duct. The central body and the gas flow duct form an annular nozzle for the discharge of gas from the duct. A plurality of flow directing vanes are disposed about the central body to impart swirl to a gas flow through the nozzle. The flow directing vanes have substantially straight leading end portions radiating outwardly from the central body and extending along the duct. The vanes also have substantially helical trailing end portions extending helically about the central body toward the front end of the duct and transition portions joining the leading end portions to the trailing end portions. The transition portions are shaped so as to merge smoothly with both the leading end portions and the trailing end portions and to smoothly and progressively change shape between them.

30 Claims, 6 Drawing Sheets

INDUCING SWIRL IN A GAS FLOW

TECHNICAL FIELD

This invention relates to swirl inducers for inducing swirl in gas flows. It has particular but not exclusive application to apparatus for injecting a flow of gas with swirl into a metallurgical vessel under high temperature conditions. Such metallurgical vessel may for example be a smelting vessel in which molten metal is produced by a direct smelting process.

A known direct smelting process, which relies on a molten metal layer as a reaction medium, and is generally referred to as the HIsmelt process, is described in International application PCT/AU96/00197 (WO 96/31627) in the name of the applicant.

The HIsmelt process as described in the International application comprises:

(a) forming a bath of molten iron and slag in a vessel;

(b) injecting into the bath:

(i) a metalliferous feed material, typically metal oxides; and (ii) a solid carbonaceous material, typically coal, which acts as a reductant of the metal oxides and a source of energy; and (c) smelting metalliferous feed material to metal in the metal layer.

The term "smelting" is herein understood to mean thermal processing wherein chemical reactions that reduce metal oxides take place to produce liquid metal.

The HIsmelt process also comprises post-combusting reaction gases, such as CO and $H_2$ released from the bath in the space above the bath with oxygen-containing gas and transferring the heat generated by the post-combustion to the bath to contribute to the thermal energy required to smelt the metalliferous feed materials.

The HIsmelt process also comprises forming a transition zone above the nominal quiescent surface of the bath in which there is a favourable mass of ascending and thereafter descending droplets or splashes or streams of molten metal and/or slag which provide an effective medium to transfer to the bath the thermal energy generated by post-combusting reaction gases above the bath.

In the HIsmelt process the metalliferous feed material and solid carbonaceous material is injected into the metal layer through a number of lances/tuyeres which are inclined to the vertical so as to extend downwardly and inwardly through the side wall of the smelting vessel and into the lower region of the vessel so as to deliver the solids material into the metal layer in the bottom of the vessel. To promote the post combustion of reaction gases in the upper part of the vessel, a blast of hot air, which may be oxygen enriched, is injected into the upper region of the vessel through the downwardly extending hot air injection lance. To promote effective post combustion of the gases in the upper part of the vessel, it is desirable that the incoming hot air blast exit the lance with a swirling motion. To achieve this, the outlet end of the lance may be fitted with internal flow guides to impart an appropriate swirling motion. The upper regions of the vessel may reach temperatures of the order of 2000° C. and the hot air may be delivered into the lance at temperatures of the order of 1100-1400° C. The lance must therefore be capable of withstanding extremely high temperatures both internally and on the external walls, particularly at the delivery end of the lance which projects into the combustion zone of the vessel.

A lance construction suitable for injecting gas into a metallurgical vessel for performing the HIsmelt process is disclosed in International Application No. PCT/AU02/00458

(WO 02/083958) in the name of the applicant. In that apparatus the gas flows through a gas flow duct within which there is an elongate central tubular structure and a plurality of flow directing vanes disposed about the central tubular structure toward the forward end of the duct to impart swirl to gas flowing through the duct. The swirl imparting vanes are disposed in a four-start helical formation with each vane being of helical form throughout its length and extending through a rotation of 180° to impart substantial swirl to the gas flow. It has been found that vanes of this form also impart substantial turbulence to the flow which can actually detract from the amount of swirl induced. By the present invention, the shaping of the swirl vanes can be modified so as to enable swirl to be induced with reduced turbulence. Moreover, modification of the shaping of the vanes in accordance with the invention can also facilitate their manufacture. For high temperature applications such as in the HIsmelt process, the vanes must be cast from high melting temperature material which can be difficult to mould into complex shapes.

DISCLOSURE OF THE INVENTION

According to the invention, apparatus for injecting gas into a vessel may include:

a gas flow duct extending from a rear end to a forward end from which to discharge gas from the duct;

a central body within a forward end region of the duct and co-acting therewith to form an annular nozzle for the discharge of gas from the duct; and a plurality of flow directing vanes disposed about the central body to impart swirl to a gas flow through the nozzle;

wherein the flow directing vanes have substantially straight leading end portions radiating outwardly from the central body and extending along the duct, substantially helical trailing end portions extending helically about the central body toward the front end of the duct, and transition portions joining the leading end portions to the trailing end portions and shaped so as to merge smoothly with both the leading end portions and the trailing end portions and to smoothly and progressively change shape between them.

The leading end portions of the vanes may taper in thickness in the longitudinal direction so as to progressively increase in thickness from leading edges of the vanes to the transition portions of the vanes.

The vanes may also progressively reduce in thickness radially outwards of the vanes. They may for example be of generally trapezoidal cross-section and taper from their roots to tips which are thinner than the roots.

The radial cross-sections of the vanes may be generally constant throughout the transitional and trailing end portions.

There may be four vanes spaced circumferentially about the central body so as to progress from the leading end portions through the transition portions into a four-start helical formation.

The straight leading end portions of the vanes may extend through less than 20% of the overall length of the vanes measured longitudinally of the duct. The length of the leading end portions may be minimised so as to extend through only about 20 mm which may be as little as 3 to 4% of the overall length of the vanes.

The transition portions of the vanes may also extend through at least 20% of the overall length of the vanes measured along the length of the duct.

The straight leading end portions and the transition portions of the vanes may together extend through a length which is in the range 0.4-0.8 of the outer diameter of the vanes.

Each vane may rotate through an angle in the range 80°-120° between its leading edge and trailing edge.

The angle of rotation may be about 90° so that each vane extends through about one quarter of a full turn about the central body between its leading and trailing edges. Each vane may in its transition portion rotate through an angle in the range 10°-20° and through its trailing end portion may rotate through a further angle in the range 60°-80°.

More specifically, each vane may through its transition portion rotate through an angle of about 13°-14° and may through its trailing end portion rotate through a further angle of between 76° and 77°.

The angle of the helical portions of the vanes relative to the longitudinal axis of the duct may be such as to produce in the gas discharging from the duct a swirl in the range 0.3-0.7, preferably about 0.5.

The central body may be formed by a leading end part of an elongate central tubular structure extending within the gas flow duct from its rear end to its forward end and the vanes may be mounted thereon.

The vanes may be formed integrally with a mounting sleeve by which they are mounted on the central body.

The invention also extends to a gas swirl inducer for mounting in a gas flow duct for imparting swirl to gas flowing therethrough, comprising a central elongate portion and a plurality of swirl vanes disposed about and extending along the central portion, wherein the swirl vanes have substantially straight leading end portions radiating out from the central portion and extending straight along it, substantially helical trailing end portions extending helically about the central portion, and transition portions joining the leading end portions to the trailing end portions and shaped so as to merge smoothly with both the leading end portions and the trailing end portions and to smoothly and progressively change shape between them.

BRIEF DESCRIPTION OF THE DRAWINGS

In order that the invention may be more fully explained one particular embodiment will be described in detail with reference to the accompanying drawings in which.

DETAILED DESCRIPTION OF THE PREFERRED EMBODIMENT

Figure 1:
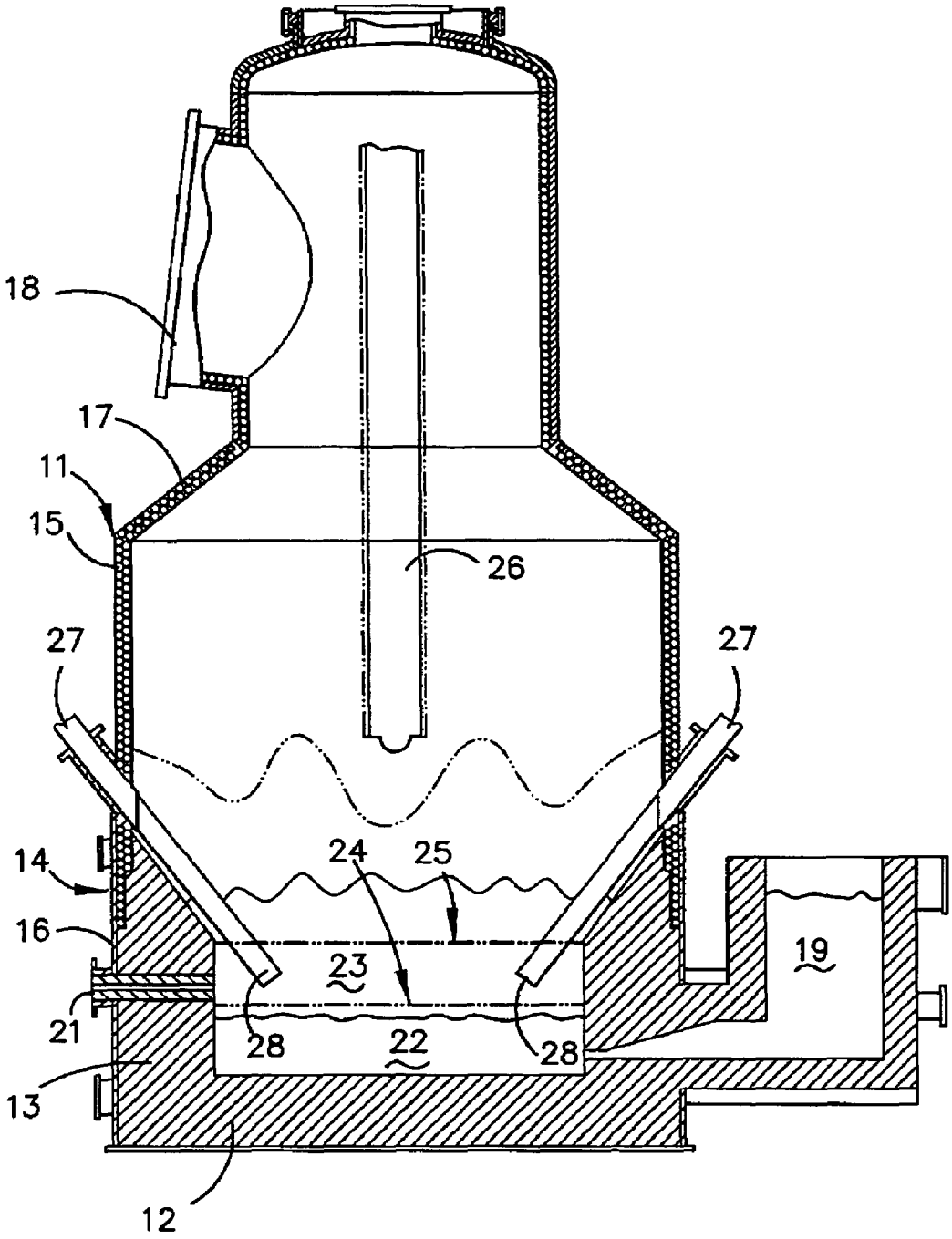
FIG. 1 is a vertical section through a direct smelting vessel incorporating a pair of solids injection lances and a hot air blast injection lance incorporating a swirl inducer in accordance with the invention.
Figure 2:
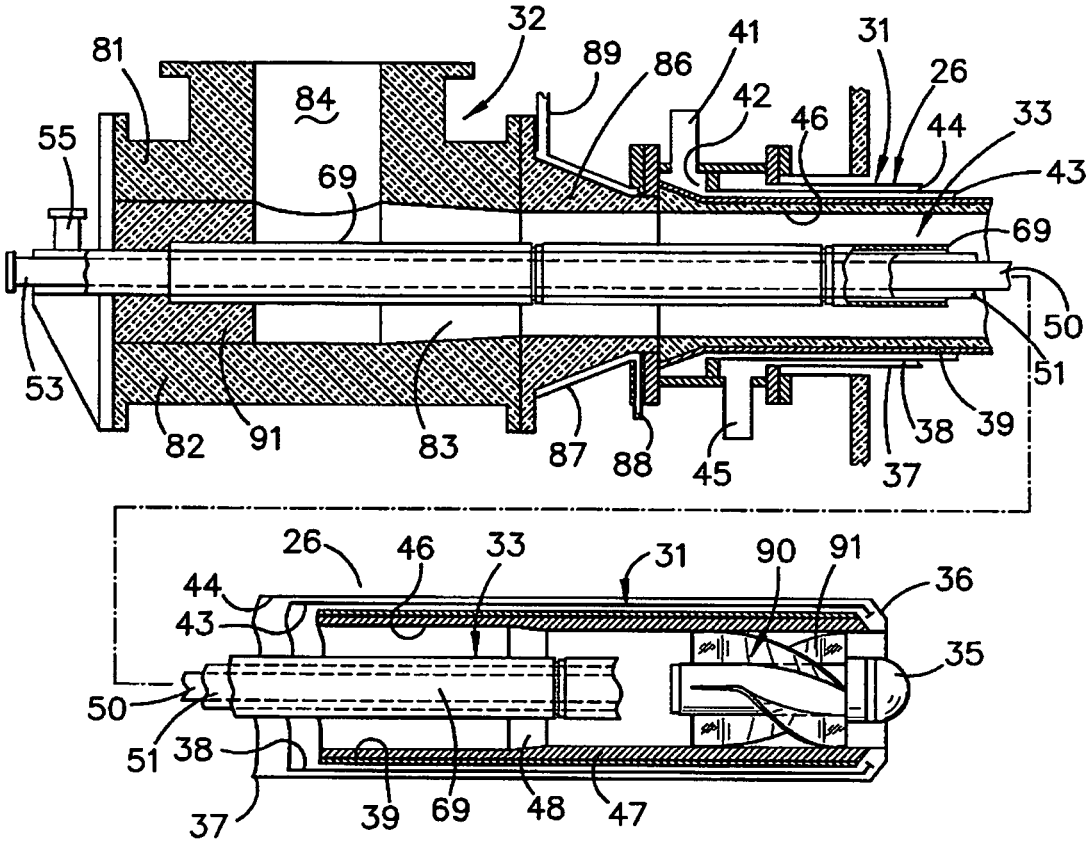
FIG. 2 is a longitudinal cross-section through the hot air injection lance.
Figure 3:
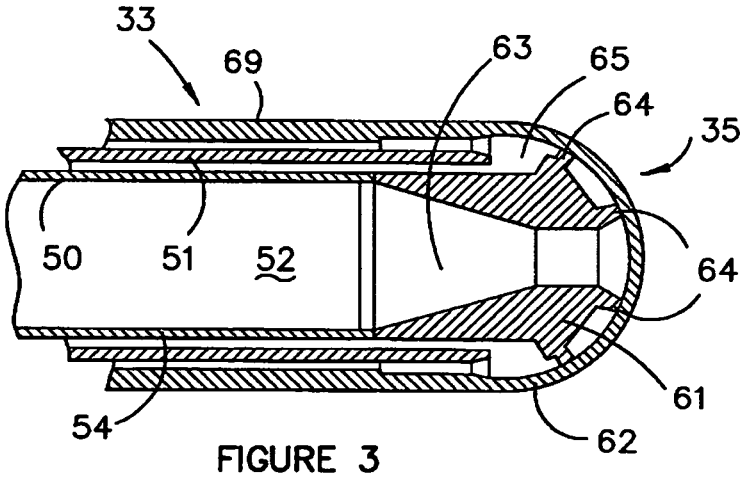
FIG. 3 is a longitudinal cross-section to an enlarged scale through a front part of a central structure of the lance.
Figure 4:
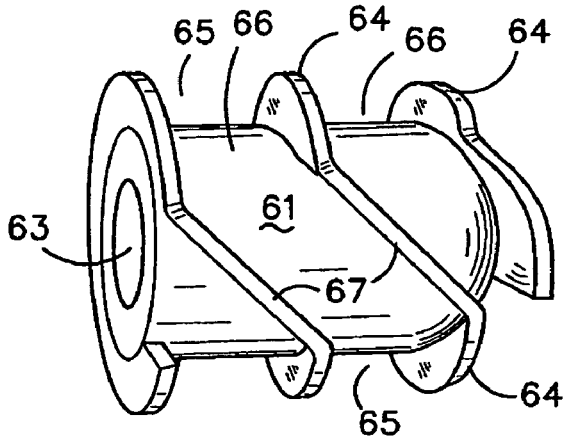
FIGS. 4 and 5 illustrate the construction of a forward nose end of the central structure.
Figure 5:
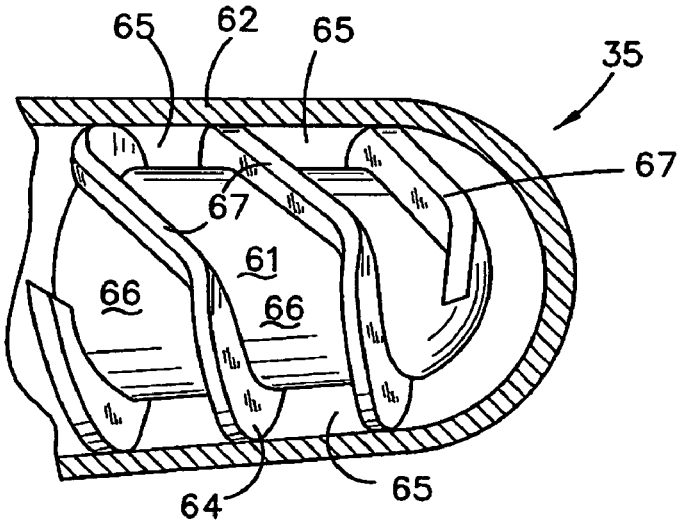
Figure 6:
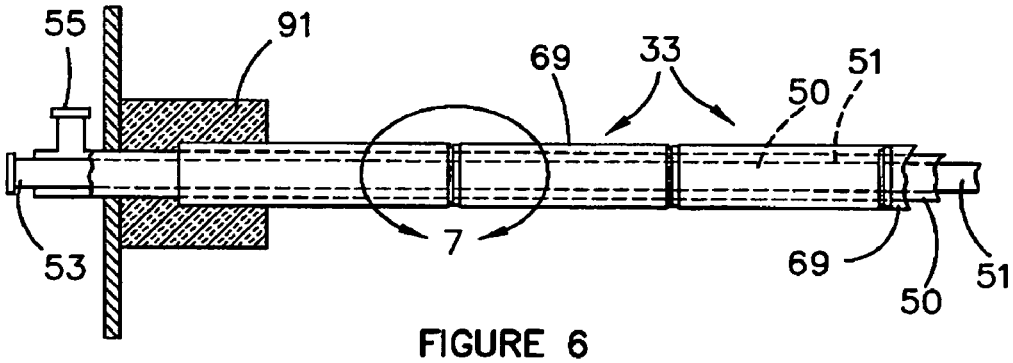
FIG. 6 is a longitudinal cross-section through the central structure.
Figure 7:
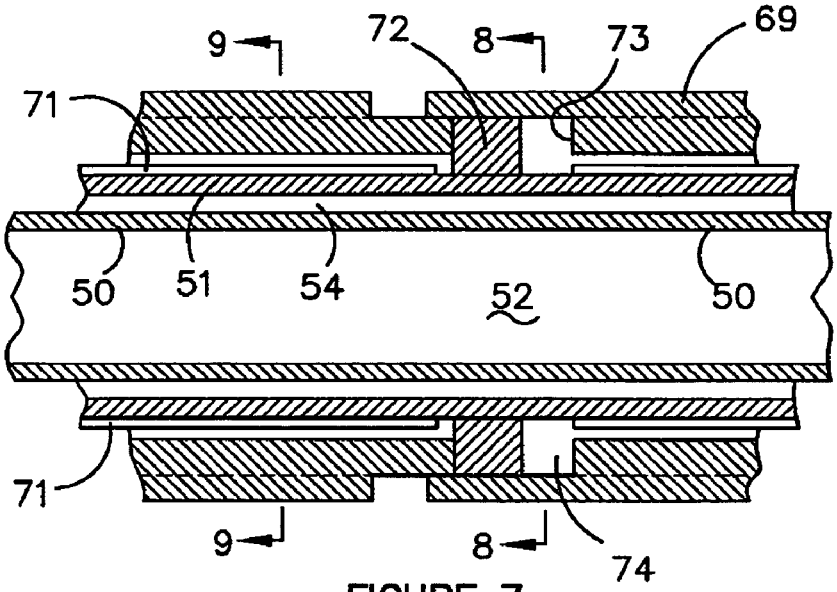
FIG. 7 shows a detail in the region 8 of FIG. 6.
Figure 8:
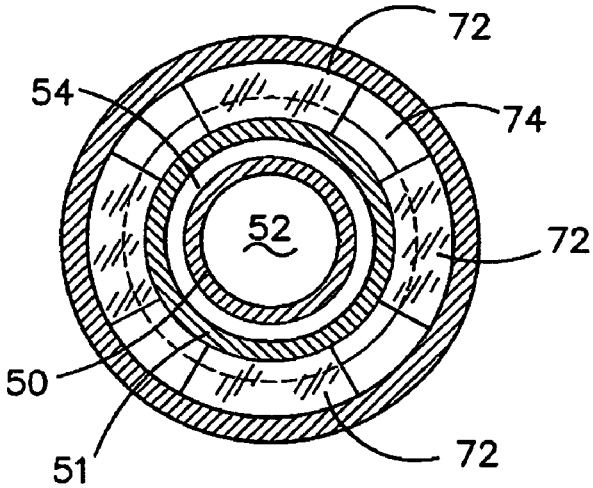
FIG. 8 is a cross-section on the line 8-8 in FIG. 7.
Figure 9:
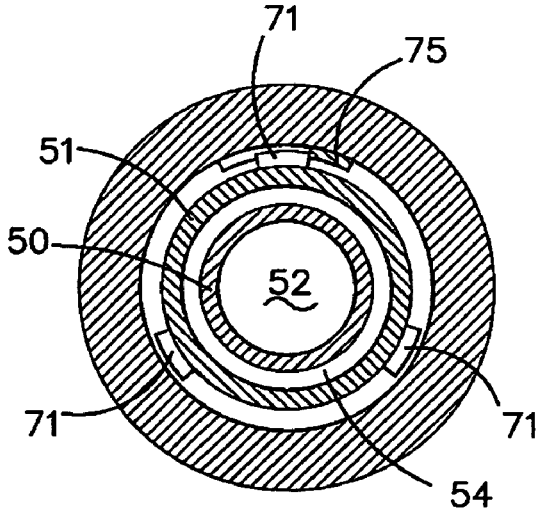
FIG. 9 is a cross-section on the line 9-9 in FIG. 7.
Figure 10:
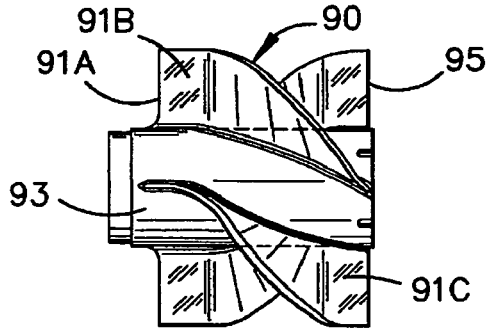
FIG. 10 illustrates the swirl inducer incorporated in the hot air injection lance.
Figure 11:
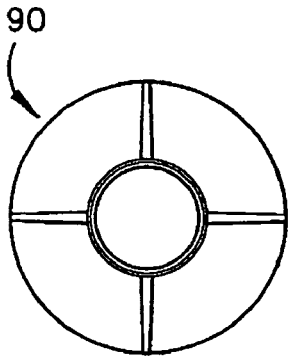
FIGS. 11 and 12 are end views of the inducer shown in FIG. 10.
Figure 12:
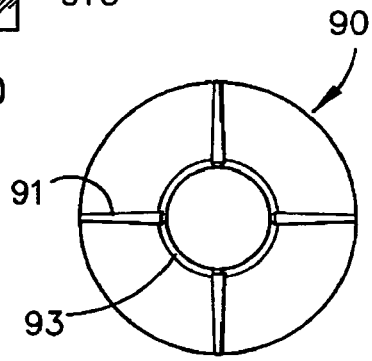
Figure 13:
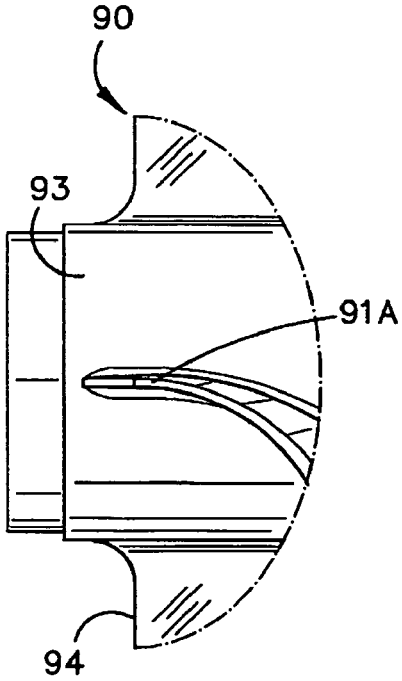
FIG. 13 is an enlarged detail of the inducer.

FIG. 1 illustrates a direct smelting vessel suitable for operation by the HIsmelt process as described in International Patent Application PCT/AU96/00197. The metallurgical vessel is denoted generally as 11 and has a hearth that includes a base 12 and sides 13 formed from refractory bricks; side walls 14 which form a generally cylindrical barrel extending upwardly from the sides 13 of the hearth and which includes an upper barrel section 15 and a lower barrel section 16; a roof 17; an outlet 18 for off-gases; a forehearth 19 for discharging molten metal continuously; and a tap-hole 21 for discharging molten slag.

In use, the vessel contains a molten bath of iron and slag which includes a layer 22 of molten metal and a layer 23 of molten slag on the metal layer 22. The arrow marked by the numeral 24 indicates the position of the nominal quiescent surface of the metal layer 22 and the arrow marked by the numeral 25 indicates the position of the nominal quiescent surface of the slag layer 23. The term "quiescent surface" is understood to mean the surface when there is no injection of gas and solids into the vessel.

The vessel is fitted with a downwardly extending hot air injection lance 26 for delivering a hot air blast into an upper region of the vessel and solids injection lances 27 (only two shown) extending downwardly and inwardly through the side walls 14 and into the slag layer 23 for injecting iron ore, solid carbonaceous material, and fluxes entrained in an oxygen-deficient carrier gas into the metal layer 22. The position of the lances 27 is selected so that their outlet ends 28 are above the surface of the metal layer 22 during operation of the process. This position of the lances reduces the risk of damage through contact with molten metal and also makes it possible to cool the lances by forced internal water cooling without significant risk of water coming into contact with the molten metal in the vessel.

The construction of the hot air injection lance 26 is illustrated in FIGS. 2-15. As shown in these figures lance 26 comprises an elongate duct 31 which receives hot gas through a gas inlet structure 32 and injects it into the upper region of vessel. The lance includes an elongate central tubular structure 33 which extends within the gas flow duct 31 from its rear end to its forward end. Adjacent the forward end of the duct, central structure 33 carries a swirl inducer 90 comprising a series of four swirl imparting vanes 91 for imparting swirl to the gas flow exiting the duct. The forward end of central structure 33 has a domed nose 35 which projects forwardly beyond the tip 36 of duct 31 so that the forward end of the central body and the duct tip co-act together to form an annular nozzle for divergent flow of gas from the duct with swirl imparted by the vanes 91.

The construction of swirl inducer 90 is illustrated in FIGS. 10-15. As shown in these figures, the inducer consists of the four vanes 91 that are formed integrally with a central tubular portion 93 which serves as a mounting sleeve by which the swirl inducer is mounted on the forward end of central structure 33. The inducer may be moulded from a high melting temperature alloy material such as UMCO 50 which contains by weight 0.05-0.12% carbon, 0.5-1% silicon, a maximum of 0.5-1% manganese, 0.02% phosphorous, 0.02% sulphur, 27-29% chromium, 48-52% cobalt and the balance essentially of iron. Such material is available commercially from several manufacturers generally under the name UMCO 50.

Figure 14:
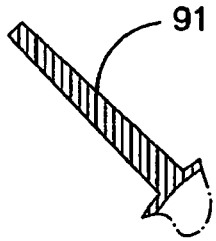
FIG. 14 is a cross-section through a swirl vane of the inducer.
Figure 15:
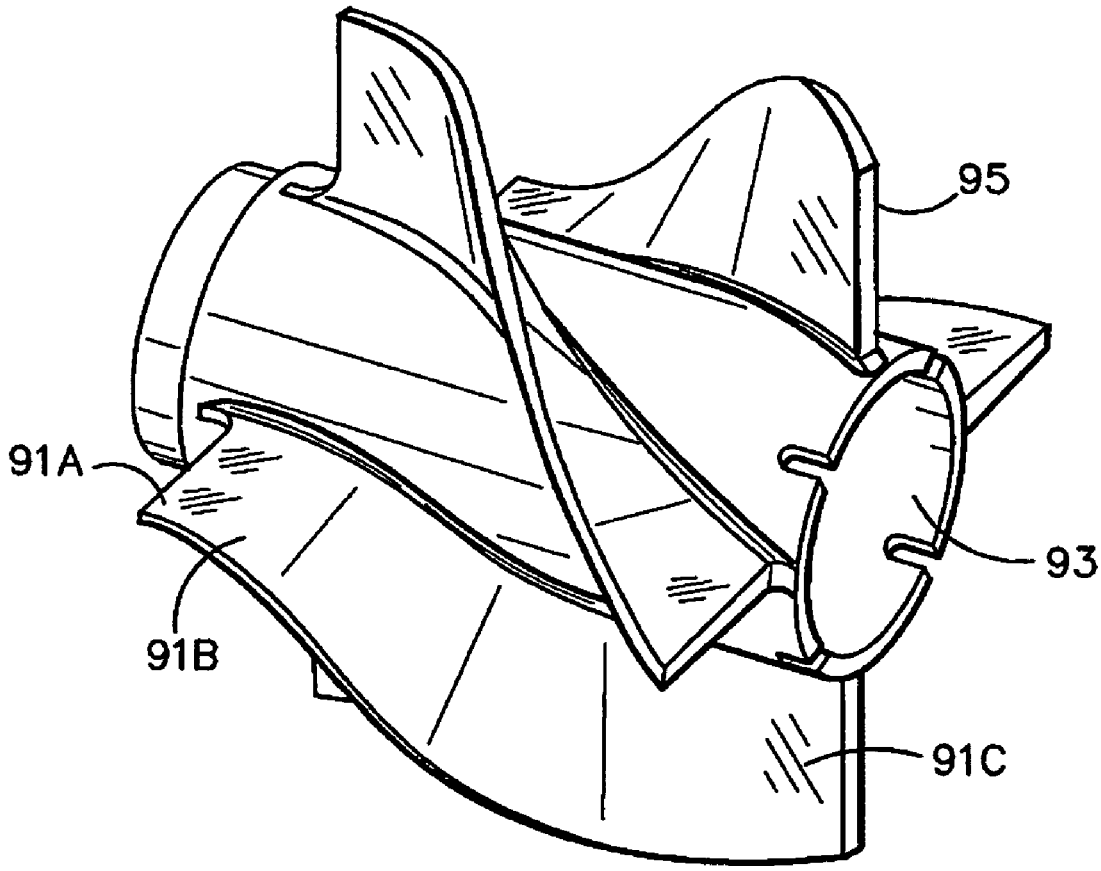
FIG. 15 illustrates the construction of the swirl inducer in FIG. 10.

The swirl vanes 91 of inducer 90 have substantially straight leading end portions 91A radiating outwardly from the central tubular body 93 and extending straight along that body, helical trailing end portions 91C extending helically about the central tubular body and transition portions 91B joining the leading end portions 91A to the trailing end portions 91C and shaped so as to merge smoothly with both the leading end portions 91A and the trailing end portions 91C and to smoothly and progressively change shape between them. The taper in thickness in the longitudinal direction throughout the transitions 91B so as to progressively increase in thickness from relatively narrow leading edges to develop full thickness at the beginning of the helical trailing end portions 91C. The vanes also taper in thickness so as to reduce in thickness in the radially outward direction and to have a trapezoidal cross-section as seen in FIG. 14. At the leading edge 94 of each vane the profile tapers from a root of 12 mm thickness to a tip of 8 mm thickness. Through the leading end portions the root thickness increases to 28 mm and the tip thickness to 20 mm. The radial cross-sections of the vanes remain constant throughout the transition and trailing end portions 91B, 91C.

Each vane 90 rotates through an angle of 90° between its leading edge 94 and its trailing edge 95. The length of the straight leading end portions 91A is minimised to about 20 mm which may be as little as 3-4% of the overall length of the vanes whereas the transition portions 91B extend through a significant part of the overall length of the vanes. Specifically, the transition portions may extend through at least 20% of the overall length of the vanes as measured along the length of the tubular body 93. It has been found that the shaping of the vanes in this way enhances a uniform flow of gas to efficiently impart swirl while minimising turbulence. The extended straight leading end portions 91A of the vanes partition the gas into quadrants about the central body 93 so that when the gas reaches the transition portions of the vanes any low pressure regions created by the changing gas flow direction cannot result in gas being drawn from an adjacent part of the flow (as can happen if the gas enters helical swirl vanes without extended straight and transition sections).

In a typical hot air injection lance used in operation of the HIsmelt process, the gas flow duct may have a diameter of the order of 782 mm with the swirl vanes 91 produced to a similar diameter so as to be a sliding fit within the duct. The central tubular body of the inducer 90 may have an outside diameter of the order of 334 mm and the overall length of the inducer may be 745 mm. The vanes may have an overall length of the order of 595 mm as measured axially of the tubular body 93 with the straight portions 91A of the vanes 91 occupying a length of the order of 20 mm and the transition portions 91B a length of the order of 170 mm. The transition portions 91B of the vanes may turn through an angle of 13.3° with the helical portions 91C rotating through the remaining 76.7° so as to produce the 90° rotation of the vanes between their leading and trailing edges. Computer modelling by the Applicant has indicated that with these dimensions a swirl within the range of 0.3-0.7 preferably of the order of 0.5 at a flow rate of 140,000 $Nm^3/h$, at a temperature of 1200° C. and at an axial velocity of 300 m/s appears to be achievable.

In this regard the anticipated swirl of the gas flow through the swirl inducer 90 was modelled using FLUENT™, a computational fluid dynamics (CFD) software package available from Fluent Inc, of New Hampshire, U.S.A. The following formula was used to model the swirl:

$$S \equiv \frac{1}{r_{lance}} \frac{\int uwr^2 dr}{\int w^2 r dr}$$

Where the variable 'S' is the swirl number of gas flow through the lance, the variable 'u' represents tangential velocity of the gas flow through the lance, the variable 'w' represents the axial velocity of the gas flow through the lance and the variable 'r' is the outer diameter of the swirl vanes.

The wall of the main part of duct 31 extending downstream from the gas inlet 32 is internally water cooled. This section of the duct is comprised of a series of three concentric steel tubes 37, 38, 39 extending to the forward end part of the duct where they are connected to the duct tip 36. The duct tip 36 is of hollow annular formation and it is internally water cooled by cooling water supplied and returned through passages in the wall of duct 31. Specifically, cooling water is supplied through an inlet 41 and annular inlet manifold 42 into an inner annular water flow passage 43 defined between the tubes 38, 39 of the duct through to the hollow interior of the duct tip 36 through circumferentially spaced openings in the tip. Water is returned from the tip through circumferentially spaced openings into an outer annular water return flow passage 44 defined between the tubes 37, 38 and backwardly to a water outlet 45 at the rear end of the water cooled section of duct 31.

The water cooled section of duct 31 is internally lined with an internal refractory lining 46 that fits within the innermost metal tube 39 of the duct and extends through to the water cooled tip 36 of the duct. The inner periphery of duct tip 36 is generally flush with the inner surface of the refractory lining which defines the effective flow passage for gas through the duct. The forward end of the refractory lining has a slightly reduced diameter section 47 which receives the swirl vanes 34 with a snug sliding fit. Rearwardly from section 47 the refractory lining is of slightly greater diameter to enable the central structure 33 to be inserted downwardly through the duct on assembly of the lance until the swirl vanes 34 reach the forward end of the duct where they are guided into snug engagement with refractory section 47 by a tapered refractory land 48 which locates and guides the vanes into the refractory section 47.

The front end of central structure 33 which carries the swirl vanes 34 is internally water cooled by cooling water supplied forwardly through the central structure from the rear end to the forward end of the lance and then returned back along the central structure to the rear end of the lance. This enables a very strong flow of cooling water directly to the forward end of the central structure and to the domed nose 35 in particular which is subjected to very high heat flux in operation of the lance.

Central structure 33 comprises inner and outer concentric steel tubes 50, 51 formed by tube segments, disposed end to end and welded together. Inner tube 50 defines a central water flow passage 52 through which water flows forwardly through the central structure from a water inlet 53 at the rear end of the lance through to the front end nose 35 of the central structure and an annular water return passage 54 defined between the two tubes through which the cooling water returns from nose 35 back through the central structure to a water outlet 55 at the rear end of the lance.

The nose end 35 of central structure 33 comprises an inner copper body 61 fitted within an outer domed nose shell 62 also formed of copper. The inner copper piece 61 is formed with a central water flow passage 63 to receive water from the central passage 52 of structure 33 and direct it to the tip of the nose. Nose end 35 is formed with projecting ribs 64 which fit snugly within the nose shell 62 to define a single continuous cooling water flow passage 65 between the inner section 61 and the outer nose shell 62. As seen particularly in FIGS. 4 and 5. The ribs 64 are shaped so that the single continuous passage 65 extends as annular passage segments 66 interconnected by passage segments 67 sloping from one annular segment to the next. Thus passage 65 extends from the tip of the nose in a spiral which, although not of regular helical formation, does spiral around and back along the nose to exit at the rear end of the nose into the annular return passage formed between the tubes 51, 52 of central structure 33.

The forced flow of cooling water in a single coherent stream through spiral passage 65 extending around and back along the nose end 35 of central structure ensures efficient heat extraction and avoids the development of "hot spots" on the nose which could occur if the cooling water is allowed to divide into separate streams at the nose. In the illustrated arrangement the cooling water is constrained in a single stream from the time that it enters the nose end 35 to the time that it exits the nose end.

Inner structure 33 is provided with an external heat shield 69 to shield against heat transfer from the incoming hot gas flow in the duct 31 into the cooling water flowing within the central structure 33. If subjected to the very high temperatures and high gas flows required in a large scale smelting installation, a solid refractory shield may provide only short service. In the illustrated construction the shield 69 is formed of tubular sleeves of high melting temperature alloy. These sleeves are arranged end to end to form a continuous heat shield surrounding an air gap 70 between the shield and the outermost tube 51 of the central structure. In particular the shield may be made of tubular segments of the material UMCO 50 as described above. This material provides excellent heat shielding but it undergoes significant thermal expansion at high temperatures. To deal with this problem the individual tubular segments of the heat shield are formed and mounted as shown in FIGS. 6-9 to enable them to expand longitudinally independently of one another while maintaining a substantially continuous shield at all times. As illustrated in those figures the individual sleeves are mounted on location strips 71 and plate supports 72 fitted to the outer tube 51 of central structure 33, the rear end of each shield tube being stepped at 73 to fit over the plate support with an end gap 74 to enable independent longitudinal thermal expansion of each strip. Anti-rotation strips 75 may also be fitted to each sleeve to fit about one of the location strips 71 on tube 52 to prevent rotation of the shield sleeves.

Hot gas is delivered to duct 31 through the gas inlet section 32. The hot gas may be oxygen enriched air provided through heating stoves at a temperature of the order of 1200° C. This air must be delivered through refractory lined ducting and it will pick up refractory grit which can cause severe erosion problems if delivered at high speed directly into the main water cooled section of duct 31. Gas inlet 32 is designed to enable the duct to receive high volume hot air delivery with refractory , particles while minimising damage of the water cooled section of the duct. Inlet 31 comprises a T-shaped body 81 moulded as a unit in a hard wearing refractory material and located within a thin walled outer metal shell 82. Body 81 defines a first tubular passage 83 aligned with the central passage of duct 31 and a second tubular passage 84 normal to passage 83 to receive the hot airflow delivered from stoves (not shown). Passage 83 is aligned with the gas flow passage of duct 31 and is connected to it through a central passage 85 in a refractory connecting piece 86 of inlet 32.

The hot air delivered to inlet 32 passes through tubular passage 84 of body 81 and impinges on the hard wearing refractory wall of the thick refractory body 82 which is resistant to erosion. The gas flow then changes direction to flow at right angles down through passage 83 of the T-shaped body 81 and the central passage 85 of transition piece 86 and into the main part of the duct. The wall of passage 83 may be tapered in the forward flow direction so as to accelerate the flow into the duct. It may for example be tapered to an included angle of the order of 7°. The transition refractory body 86 is tapered in thickness to match the thick wall of refractory body 81 at one end and the much thinner refractory lining 48 of the main section of duct 31. It is accordingly also water cooled through an annular cooling water jacket 87 through which cooling water is circulated through an inlet 88 and an outlet 89. The rear end of central structure 33 extends through the tubular passage 83 of gas inlet 32. It is located within a refractory liner plug 91 which closes the rear end of passage 83, the rear end of central structure 33 extending back from gas inlet 32 to the water flow inlet 53 and outlet 55.

The illustrated apparatus is capable of injecting high volumes of hot gas into the smelting vessel 26 at high temperature. The central structure 33 is capable of delivering large volumes of cooling water quickly and directly to the nose section of the central structure and the forced flow of that cooling water in an undivided cooling flow around the nose structure enables very efficient heat extraction from the front end of the central structure. The independent water flow to the tip of the duct also enables efficient heat extraction from the other high heat flux components of the lance. Delivery of the hot air flow into an inlet in which it impacts with a thick wall of a refractory chamber or passage before flowing downwardly into the duct enables high volumes of air contaminated with refractory grit to be handled without severe erosion of the refractory lining and heat shield in the main section of the lance.

It has been found that the swirl inducer 90 having the swirl vanes 91 formed with the straight leading end portions 91A and transition portions 91B and with the helical portions terminated so that the vanes rotate through only one quarter of a turn rather than through 180° as in previous apparatus allows swirl to be imparted with much reduced turbulence. Moreover, the vanes with the lesser turn are a less complex shape to cast and they can be much more readily manufactured from high melting temperature material such as UMCO 50.

The invention claimed is:

1. Apparatus for injecting gas at a temperature of the order of 1200° C. into a vessel, comprising;

a gas flow duct extending from a rear end to a forward end from which to discharge a gas from the duct;

a central body within a forward end region of the duct and co-acting therewith to form an annular nozzle for the discharge of gas from the duct; and a plurality of flow directing vanes disposed about the central body to impart swirl to a gas flow through the nozzle;

wherein the flow directing vanes have substantially straight leading end portions radiating outwardly from the central body and extending along the duct, substantially helical trailing end portions extending helically about the central body toward the front end of the duct, and transition portions joining the leading end portions to the trailing end portions and shaped so as to merge smoothly with both the leading end portions and the trailing end portions and to smoothly and progressively change shape between them, and wherein each vane rotates through an angle in the range of 80°-120° between its leading edge and trailing edge.

2. Apparatus as claimed in claim 1, wherein the leading parts of the vanes taper in thickness in the longitudinal direction so as to progressively increase in thickness toward the helical trailing end portions of the vanes.

3. Apparatus as claimed in claim 2, wherein the vanes progressively increase in thickness throughout the transition portions.

4. Apparatus as claimed in claim 1, wherein the radial cross-sections of the vanes are generically constant throughout the helical trailing end portions.

5. Apparatus as claimed in claim 1, wherein the vanes progressively reduce in thickness radially outwards of the vanes.

6. Apparatus as claimed in claim 5, wherein the vanes are of generally trapezoidal cross-section and taper from their roots to tips which are thinner than the roots.

7. Apparatus as claimed in claim 1, wherein there are four vanes spaced circumferentially about the central body so as to progress from the leading end portions through the transition portions into a four-start helical formation.

8. Apparatus as claimed in claim 1, wherein the straight leading end portions and the transition portions of the vanes together extend through a length which is in the range of 0.4-0.8 of the outer diameter of the vanes.

9. Apparatus as claimed in claim 1, wherein the angle of rotation of each vane is about 90° so that each vane extends through about one quarter of a full turn about the central body between its leading and trailing edges.

10. Apparatus as claimed in claim 1, or claim 9, wherein each vane in its transition portion rotates through an angle in the range 10°-20° and through its trailing end portion rotates through a further angle in the range 60°-80°.

11. Apparatus as claimed in claim 10, wherein each vane through its transition portion rotates through an angle of about 13°-14° and through its trailing end portion rotates through a further angle of between 76° and 77°.

12. Apparatus as claimed in claim 1, wherein the straight leading end portions of the vanes extend through less than 20% of the overall length of the vanes measured longitudinally of the duct.

13. Apparatus as claimed in claim 12, wherein the transition portions of the vanes extend through at least 20% of the overall length of the vanes measured along the length of the duct.

14. Apparatus as claimed in claim 1, wherein the angle of the helical portions of the vanes relative to the longitudinal axis of the duct is such as to produce in the gas discharging from the duct a swirl in the range 0.3-0.7.

15. Apparatus as claimed in claim 1, wherein the central body is formed by a leading end part of an elongate central tubular structure extending within the gas flow duct from its rear end to its forward end and the vanes are mounted thereon.

16. Apparatus as claimed in claim 15, wherein the vanes are formed integrally with a mounting sleeve by which they are mounted on the central body.

17. A gas swirl inducer for mounting in a gas flow duct for imparting swirl to gas flowing therethrough at a temperature of the order of 1200° C., comprising:

a central elongate portion and a plurality of swirl vanes disposed about and extending along the central portion, wherein the swirl vanes have substantially straight leading end portions radiating out from the central portion and extending straight along it, substantially helical trailing end portions extending helically about the central portion, and transition portions joining the leading end portions to the trailing end portions and shaped so as to merge smoothly with both the leading end portions and the trailing end portions and to smoothly and progressively change shape between them, wherein each swirl vane rotates through an angle in the range of 80°-120° between its leading edge and trailing edge.

18. A gas swirl inducer as claimed in claim 17, wherein the leading parts of the vanes taper in thickness in the longitudinal direction so as to progressively increase in thickness toward the helical trailing end portions of the vanes.

19. A gas swirl inducer as claimed in claim 18, wherein the vanes progressively increase in thickness throughout the transition portions.

20. A gas swirl inducer as claimed in claim 17, wherein the radial cross-section of the vanes are generally constant throughout the helical trailing end portions.

21. A gas swirl inducer as claimed in claim 17, wherein the vanes progressively reduce in thickness radially outwards of the vanes.

22. A gas swirl inducer as claimed in claim 21, wherein the vanes are of generally trapezoidal cross-section and taper from their roots to tips which are thinner than the roots.

23. A gas swirl inducer as claimed in claim 17, wherein there are four vanes spaced circumferentially about the central elongate portion so as to progress from the leading end portions through the transition portions into a four-start helical formation.

24. A gas swirl inducer as claimed in claim 17, wherein the straight leading end portions and the transition portions of the vanes together extend through a length which is in the range 0.4-0.8 of the outer diameter of the vanes.

25. A gas swirl inducer as claimed in claim 17, wherein the angle of rotation of each vane is about 90° so that each vane extends through about one quarter of a full turn about the central body between its leading and trailing edges.

26. A gas swirl inducer as claimed in claim 25, wherein each vane in its transition portion rotates through an angle in the range 10°-20° and through its trailing end portion rotates through a further angle in the range 60°-80°.

27. A gas swirl inducer as claimed in claim 17, wherein the straight leading end portions of the vanes extend through less than 20% of the overall length of the vanes measured longitudinally of the central elongate portion.

28. A gas swirl inducer as claimed in claim 27, wherein the transition portions of the vanes extend through at least 20% of the overall length of the vanes measured along the central elongate portion.

29. A gas swirl inducer as claimed in claim 17, wherein the vanes are formed integrally with the central elongate portion of the inducer.

30. A gas swirl inducer as claimed in claim 17, wherein the central elongate portion is cylindrical.

* * * * *